US007988482B2

(12) United States Patent
Kim et al.

(10) Patent No.: US 7,988,482 B2
(45) Date of Patent: Aug. 2, 2011

(54) CONNECTOR FOR VEHICLE EFFECTIVELY REMOVING OR REDUCING NOISE AND PROVIDING SECURE CONNECTION

(75) Inventors: Ji Hyoung Kim, Incheon (KR); Jong Wook Lee, Gyeonggi-do (KR); Sung Ho Heo, Seoul (KR)

(73) Assignees: Hyundai Motor Company, Seoul (KR); Korea Electric Terminal Co., Ltd., Incheon (KR)

( * ) Notice: Subject to any disclaimer, the term of this patent is extended or adjusted under 35 U.S.C. 154(b) by 0 days.

(21) Appl. No.: 12/752,956

(22) Filed: Apr. 1, 2010

(65) Prior Publication Data

US 2011/0111610 A1 May 12, 2011

(30) Foreign Application Priority Data

Nov. 9, 2009 (KR) ..... 10-2009-0107773

(51) Int. Cl.
*H01R 13/627* (2006.01)

(52) U.S. Cl. ..... 439/357; 439/38

(58) Field of Classification Search ..... 439/38, 439/40, 352, 357, 620.05, 620.07
See application file for complete search history.

(56) References Cited

U.S. PATENT DOCUMENTS

| | | | | |
|---|---|---|---|---|
| 4,983,932 | A * | 1/1991 | Kitagawa | 333/12 |
| 5,367,956 | A * | 11/1994 | Fogle, Jr. | 102/202.2 |
| 6,078,117 | A * | 6/2000 | Perrin et al. | 310/68 R |
| 6,332,800 | B2 * | 12/2001 | Kodama | 439/357 |
| 6,514,099 | B2 * | 2/2003 | Endo | 439/489 |
| 6,679,719 | B2 * | 1/2004 | Endo et al. | 439/352 |
| 7,128,597 | B2 * | 10/2006 | Niitsu et al. | 439/495 |
| 7,811,115 | B1 * | 10/2010 | Tyler | 439/352 |
| 2008/0009171 | A1 * | 1/2008 | Tsuji | 439/352 |
| 2008/0261437 | A1 * | 10/2008 | Kobayashi et al. | 439/352 |

FOREIGN PATENT DOCUMENTS

| | | |
|---|---|---|
| JP | 09-161899 A | 6/1997 |
| JP | 2007-005132 A | 1/2007 |
| KR | 10-2004-0075384 | 3/2005 |

* cited by examiner

*Primary Examiner* — Hae Moon Hyeon
(74) *Attorney, Agent, or Firm* — Edwards Angell Palmer & Dodge LLP; Peter F. Corless

(57) ABSTRACT

The present invention provides a connector for use in a vehicle, the connector including a male connector, a female connector and a connector cover mounted on the circumferential surface of the female connector thereby providing secure connection and removing/reducing noise of the vehicle. More specifically, the female connector includes a housing, a projection formed to project on top of the housing, an operating lever horizontally disposed over the housing in the forward and backward direction to perform a seesaw motion, and a locking projection formed at the front bottom of the operating lever. On the other hand, the male connector is configured to be inserted into the female connector and connected to the female connector by the locking projection. Furthermore, the female connector is double locked and the connector cover is molded with ferrite powder to remove or reduce noise of the vehicle.

5 Claims, 13 Drawing Sheets

CONNECTOR FOR VEHICLE EFFECTIVELY REMOVING OR REDUCING NOISE AND PROVIDING SECURE CONNECTION

CROSS-REFERENCE TO RELATED APPLICATION

This application claims under 35 U.S.C. §119(a) the benefit of Korean Patent Application No. 10-2009-0107773 filed Nov. 9, 2009, the entire contents of which are incorporated herein by reference.

BACKGROUND (a) Technical Field

The present disclosure relates to a connector for a vehicle, which can effectively remove or reduce noise and provide secure connection.

(b) Background Art

Typically, a condenser is connected to an engine and a chassis of a vehicle to remove fault current as an unnecessary current which is not grounded, thus removing noise of the vehicle.

FIG. 12 shows a prior art condenser 32 for use in a vehicle. The vehicle condenser 32 includes an epoxy resin 20 filled in the inside of the condenser 32, a terminal 12 having a terminal hole 14, and a connection unit 18 formed at an end of a terminal wire 16 and having a ring shape.

As shown in FIG. 13, the connection unit 18 is secured to a bolt 24 fixed to a lower portion of a vehicle engine 26 and then a nut 22 is tightened on the bolt 24 such that the terminal wire 16 of the condenser 10 is connected to the engine 26.

Moreover, the terminal 12 is fixed to a chassis (not shown) located at the side of the engine 26 through the terminal hole 14 by a fixing means.

Therefore, the condenser 32 fixed to the engine and the chassis serves to eliminate the fault current (unnecessary current) of the vehicle.

In order for the condenser to exhibit its maximum performance, it is more effective to install the condenser at a position at or near a noise source. However, it is not easy to install it at such a position due to limitations on the layout of the vehicle.

The above information disclosed in this Background section is only for enhancement of understanding of the background of the invention and therefore it may contain information that does not form the prior art that is already known in this country to a person of ordinary skill in the art.

SUMMARY OF THE DISCLOSURE

In one aspect, the present invention provides a connector for use in a vehicle, which can provide secure connection and remove/reduce noise. The connector according to an embodiment of the present invention includes a female connector, a male connector, a connector cover. The female connector includes an operating lever as a locking and unlocking means. The male connector is configured to be inserted into the female connector and connected to the female connector by the locking means. The connector cover is mounted on the circumferential surface of the female connector for maintaining the connected state of the female connector and the male connector. In addition, the connector cover is molded with ferrite powder, which helps to remove or reduce noise.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The above and other features of the invention are discussed infra.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
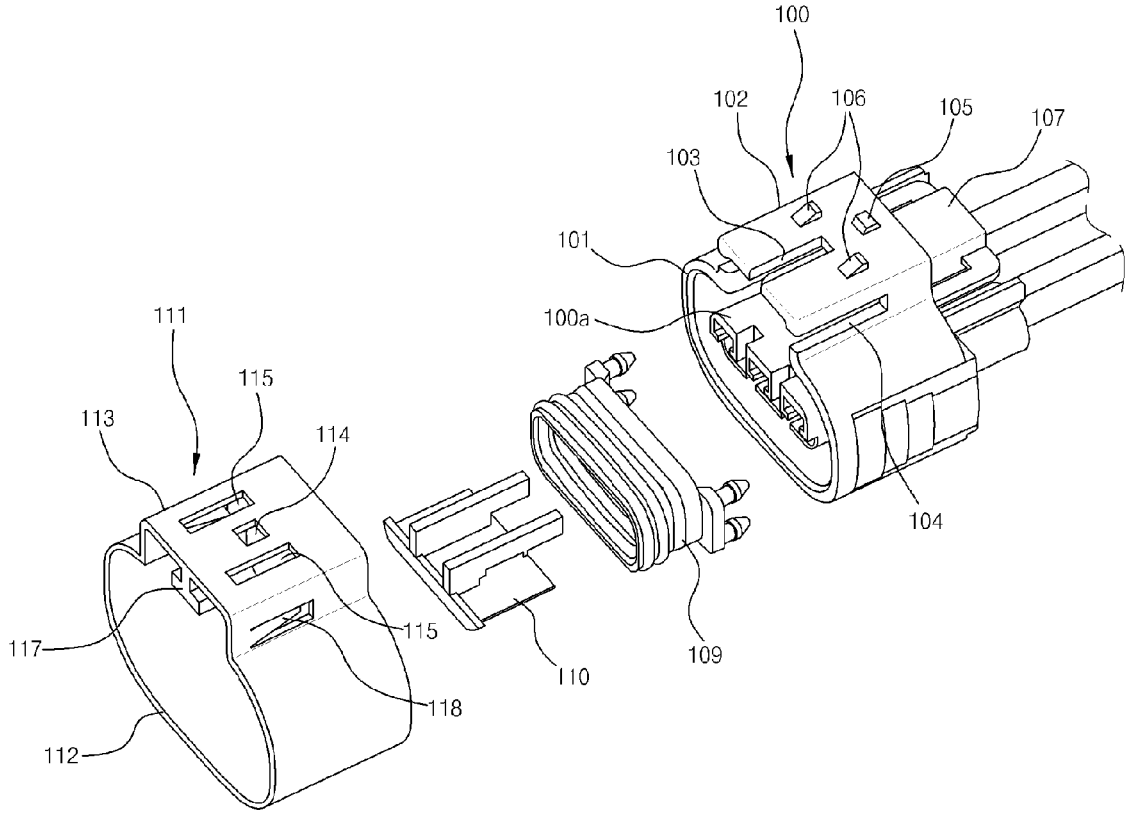
FIG. 1 is an exploded perspective of a female connector and a connector cover in accordance with an exemplary embodiment of the present invention.
Figure 2:
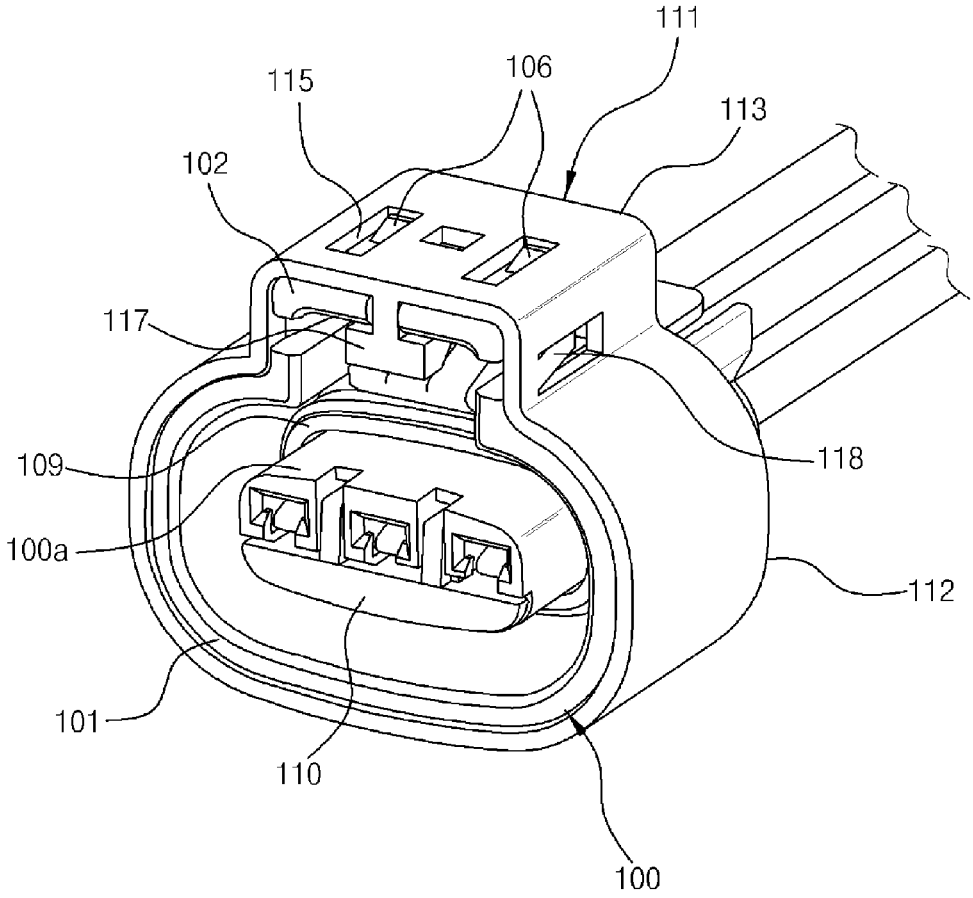
FIG. 2 is an assembled perspective view of the female connector and connector cover of FIG. 1.
Figure 3:
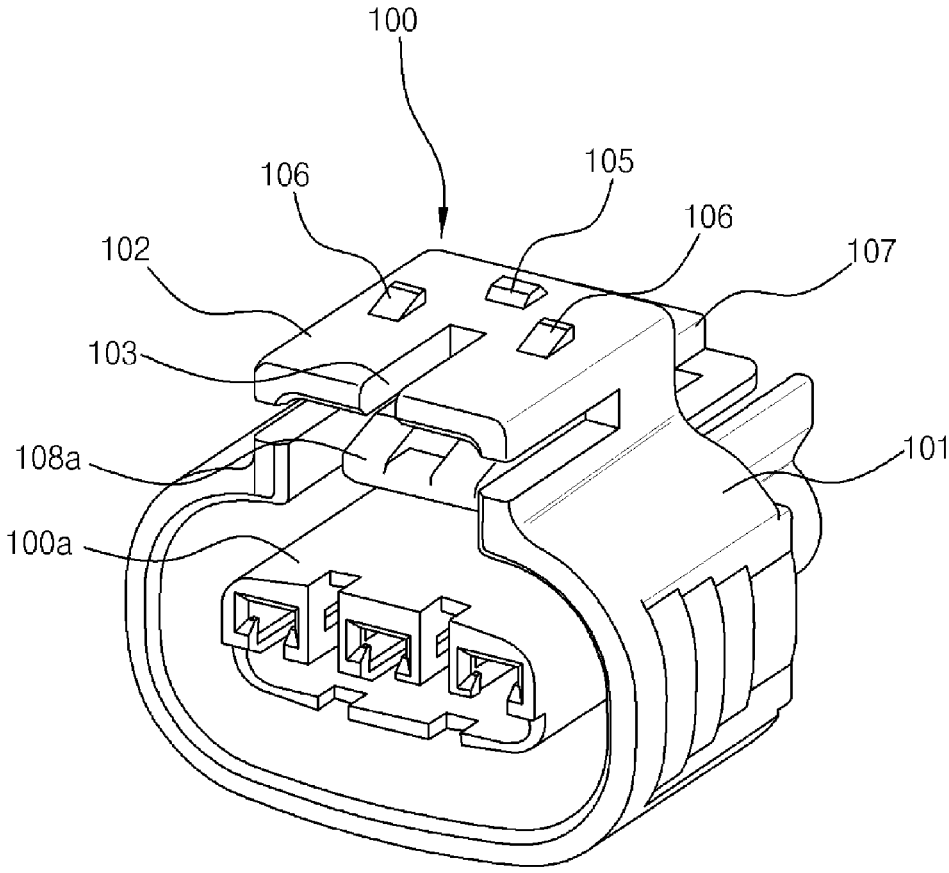
FIG. 3 is a perspective view of the female connector of FIG. 1.
Figure 4:
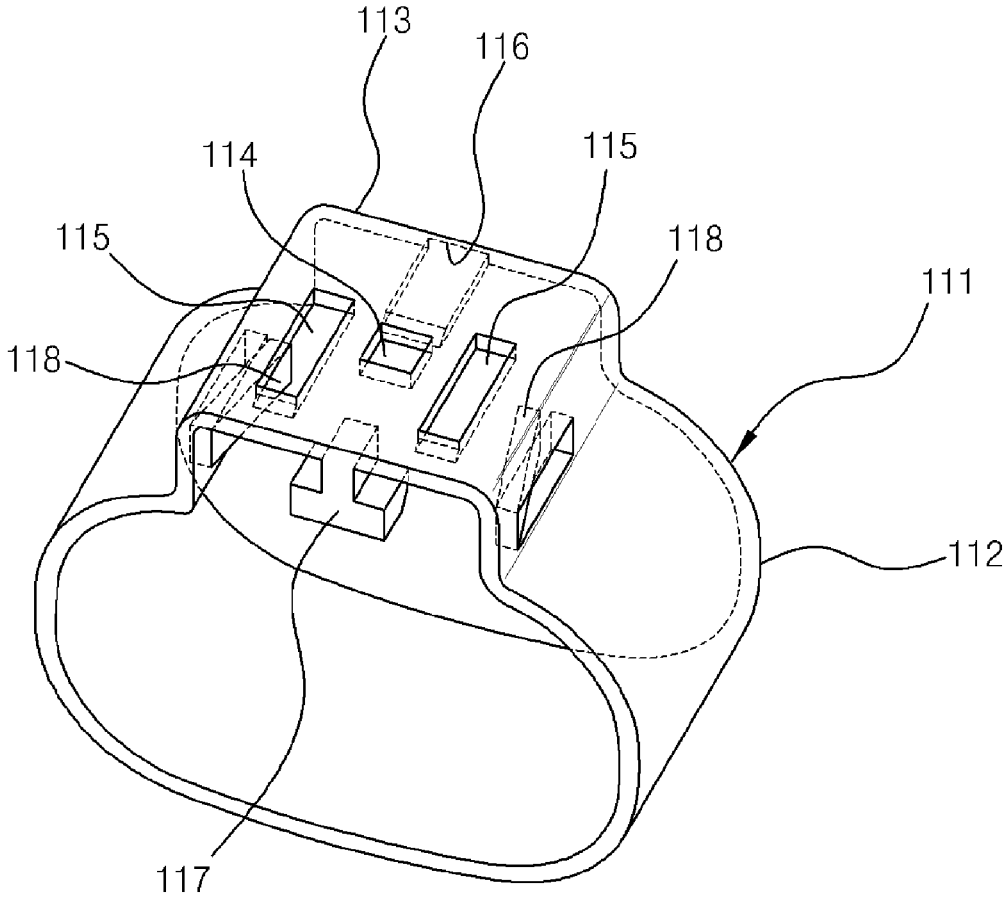
FIG. 4 is a perspective view of the connector cover of FIG. 1.
Figure 5:
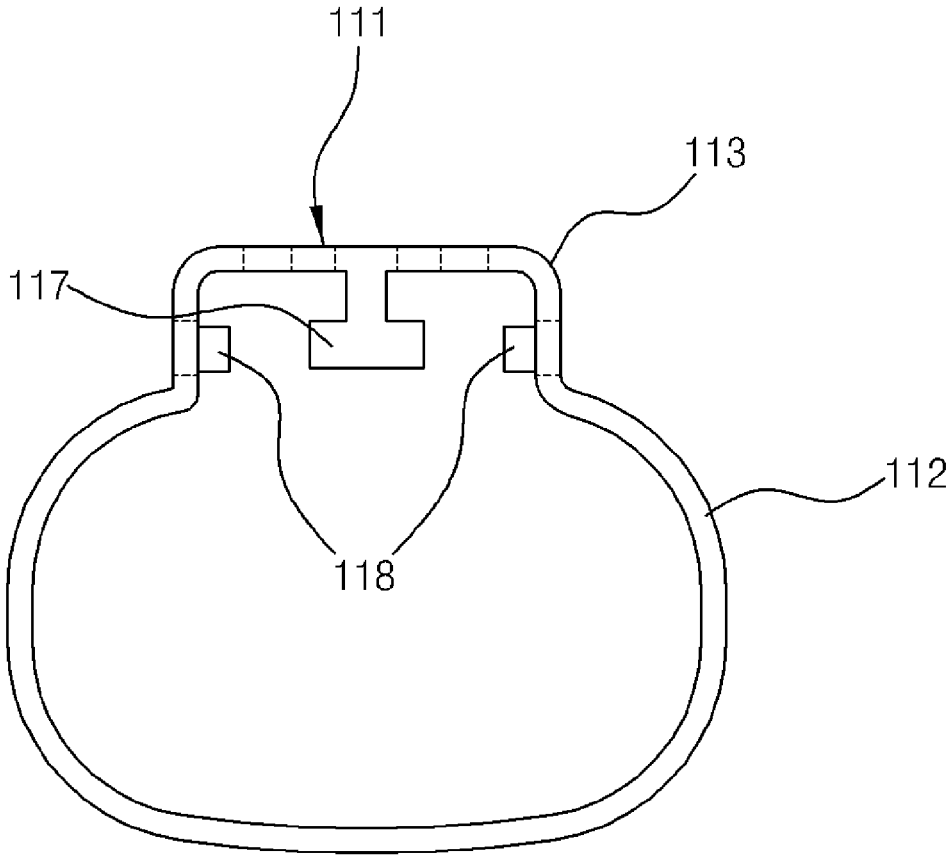
FIG. 5 is a front view of the connector cover of FIG. 4.
Figure 6:
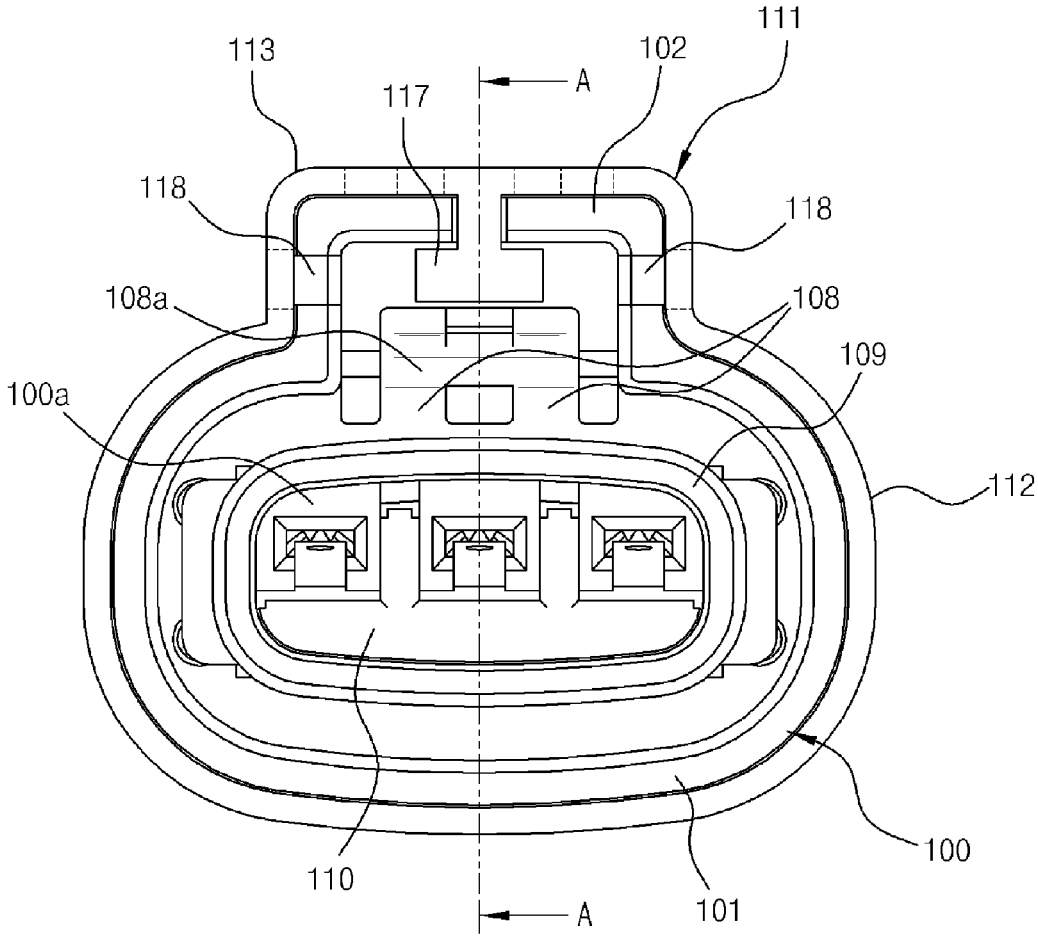
FIG. 6 is a front view of the assembled female connector and connector cover of FIG. 2.
Figure 7:
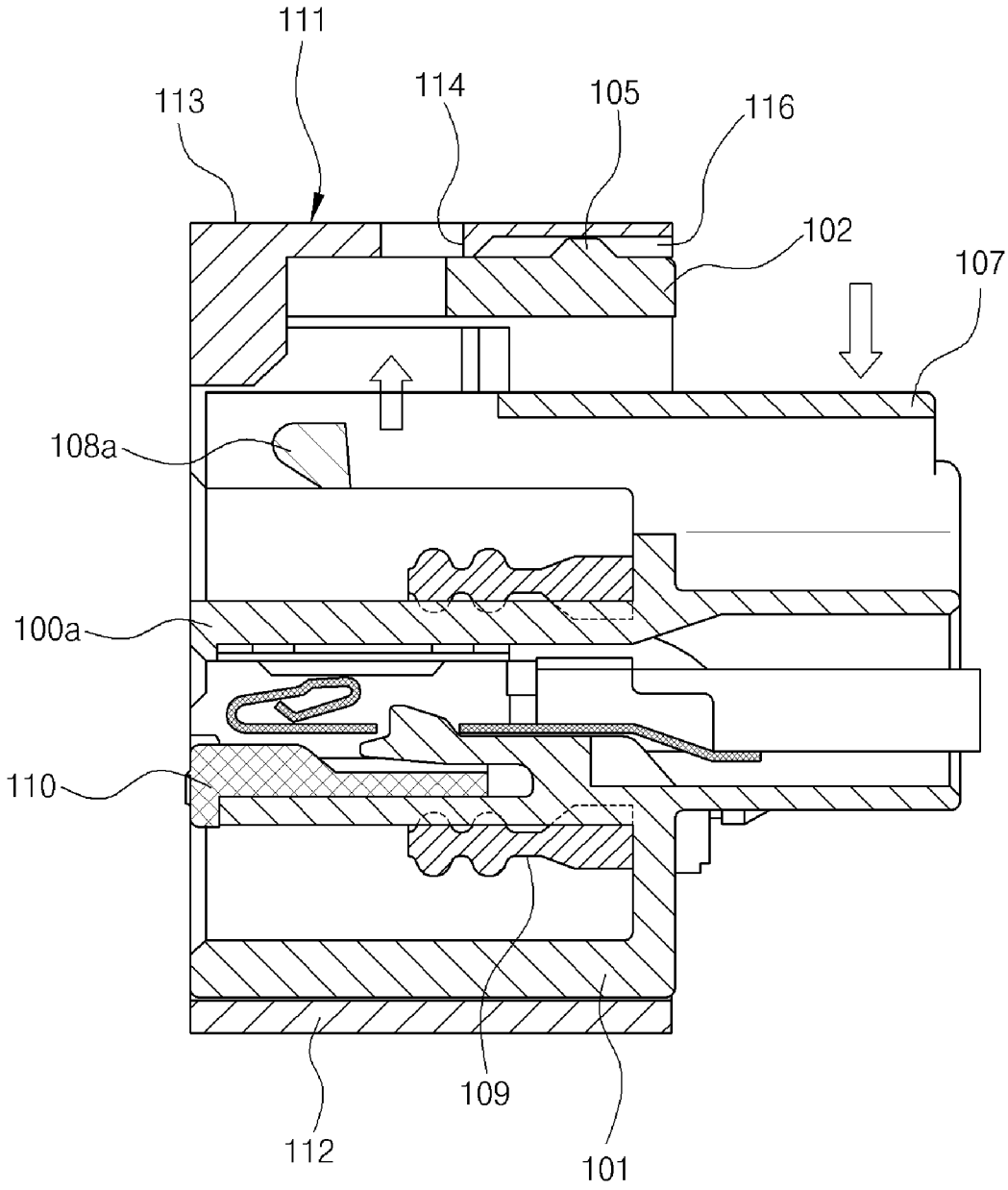
FIG. 7 is a cross-sectional view taken along line A-A of FIG. 6.
Figure 8:
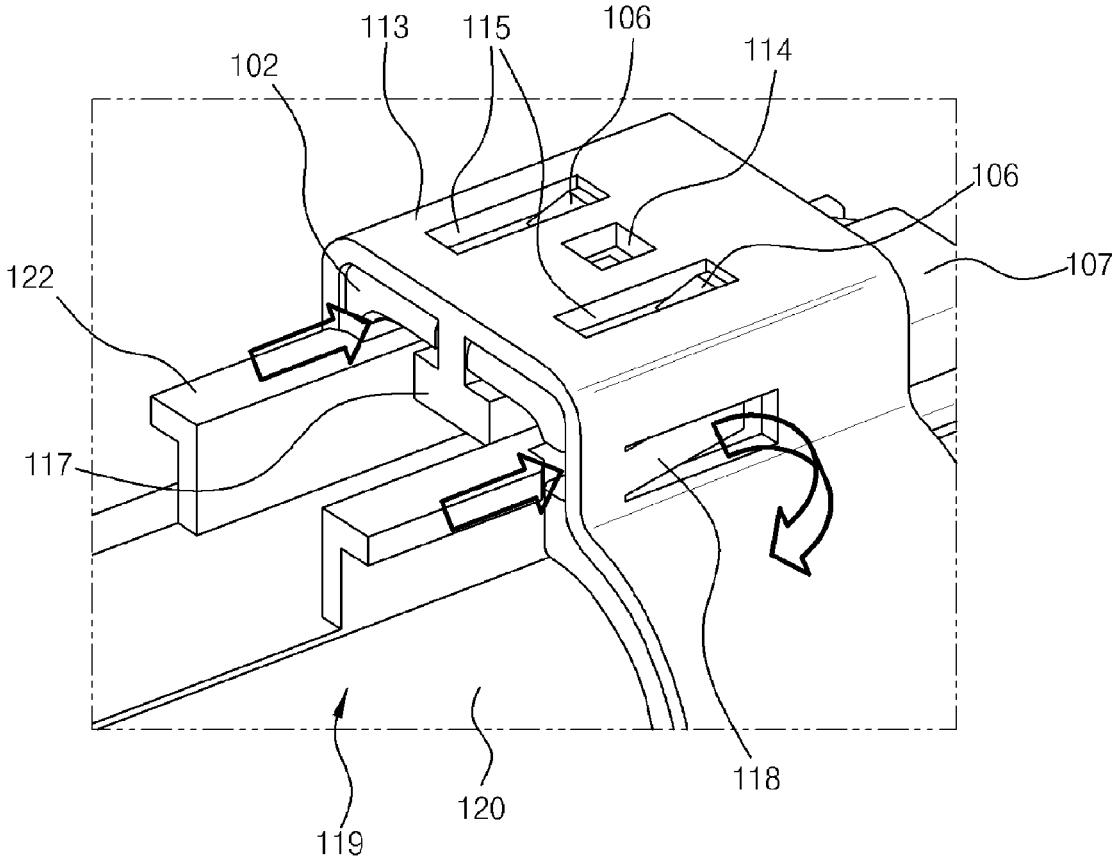
FIG. 8 is a perspective view showing a state before a male connector is inserted in FIG. 2.
Figure 9:
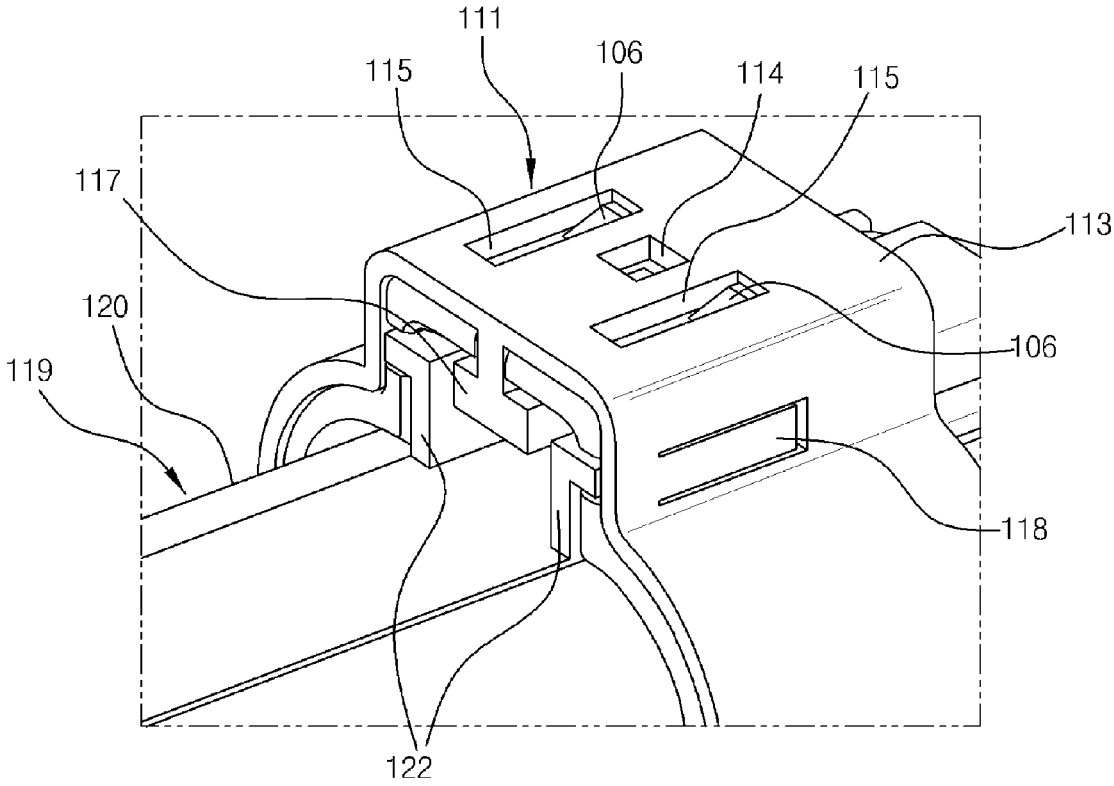
FIG. 9 is a perspective view showing a state after the male connector is inserted in FIG. 8.
Figure 10:
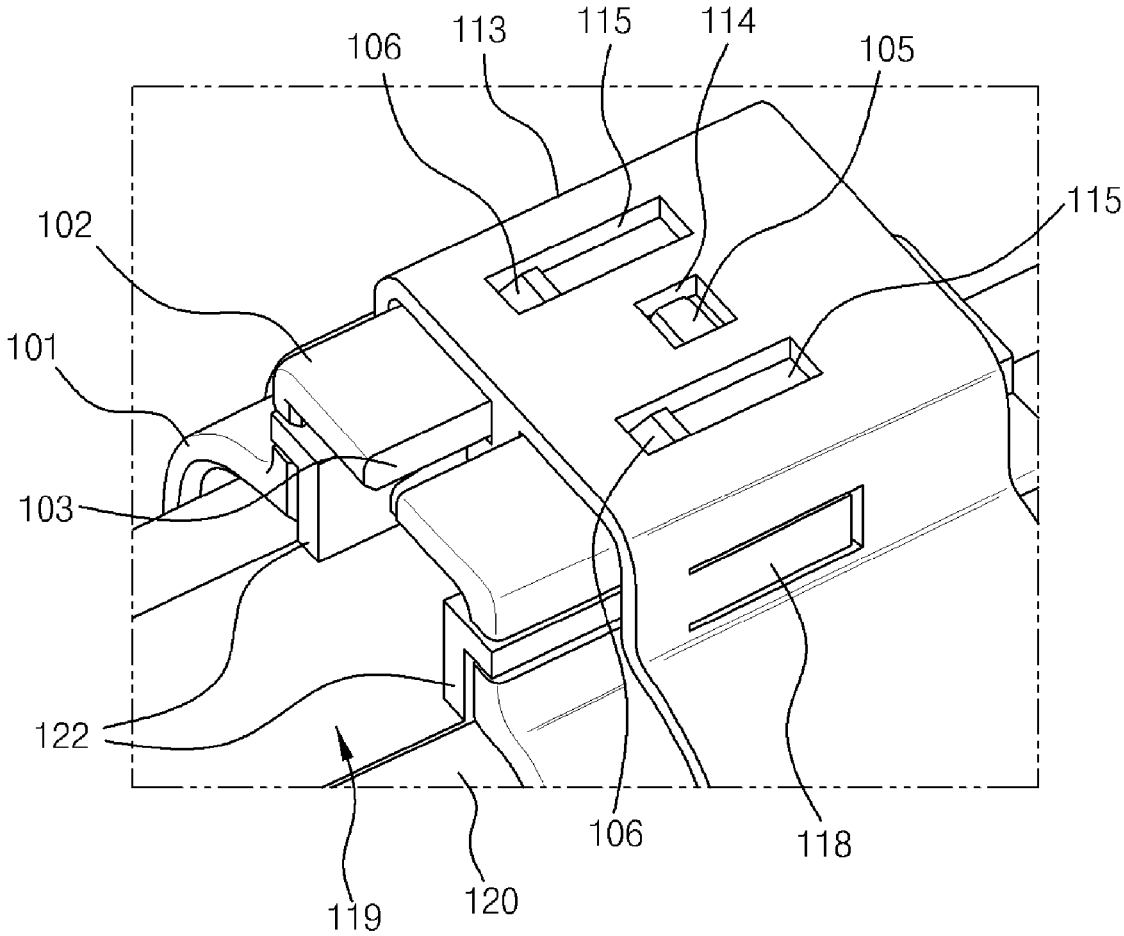
FIG. 10 is a perspective view showing a state in which the connector cover is moved backward in FIG. 9.
Figure 11:
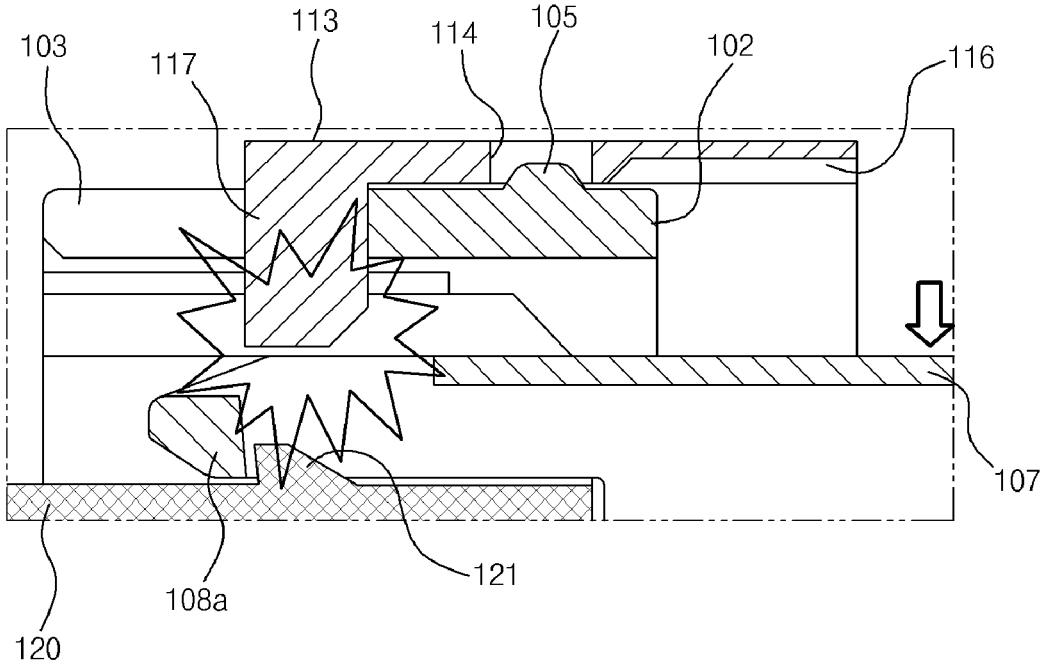
FIG. 11 is a cross-sectional view of the state of FIG. 10.
Figure 12:
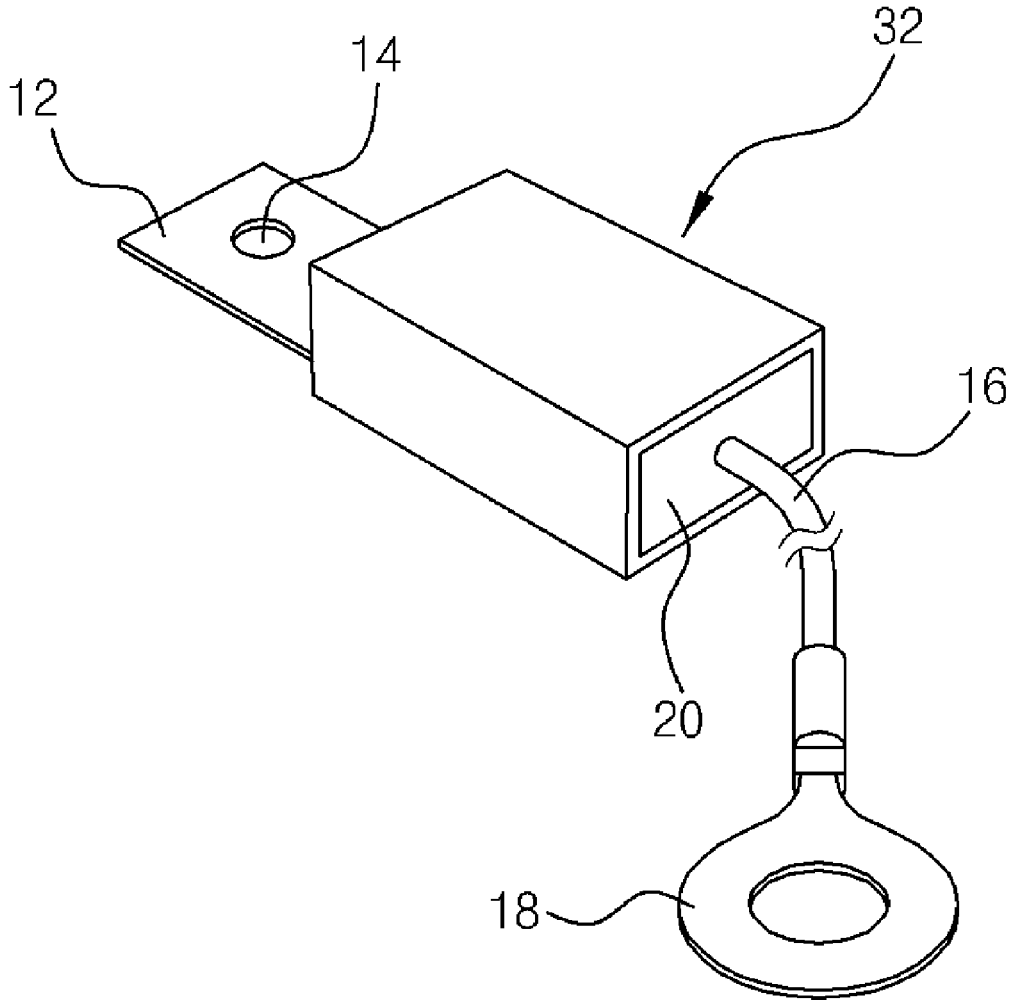
FIG. 12 (Prior Art)
FIG. 12 is a perspective view of a prior art engine condenser.
Figure 13:
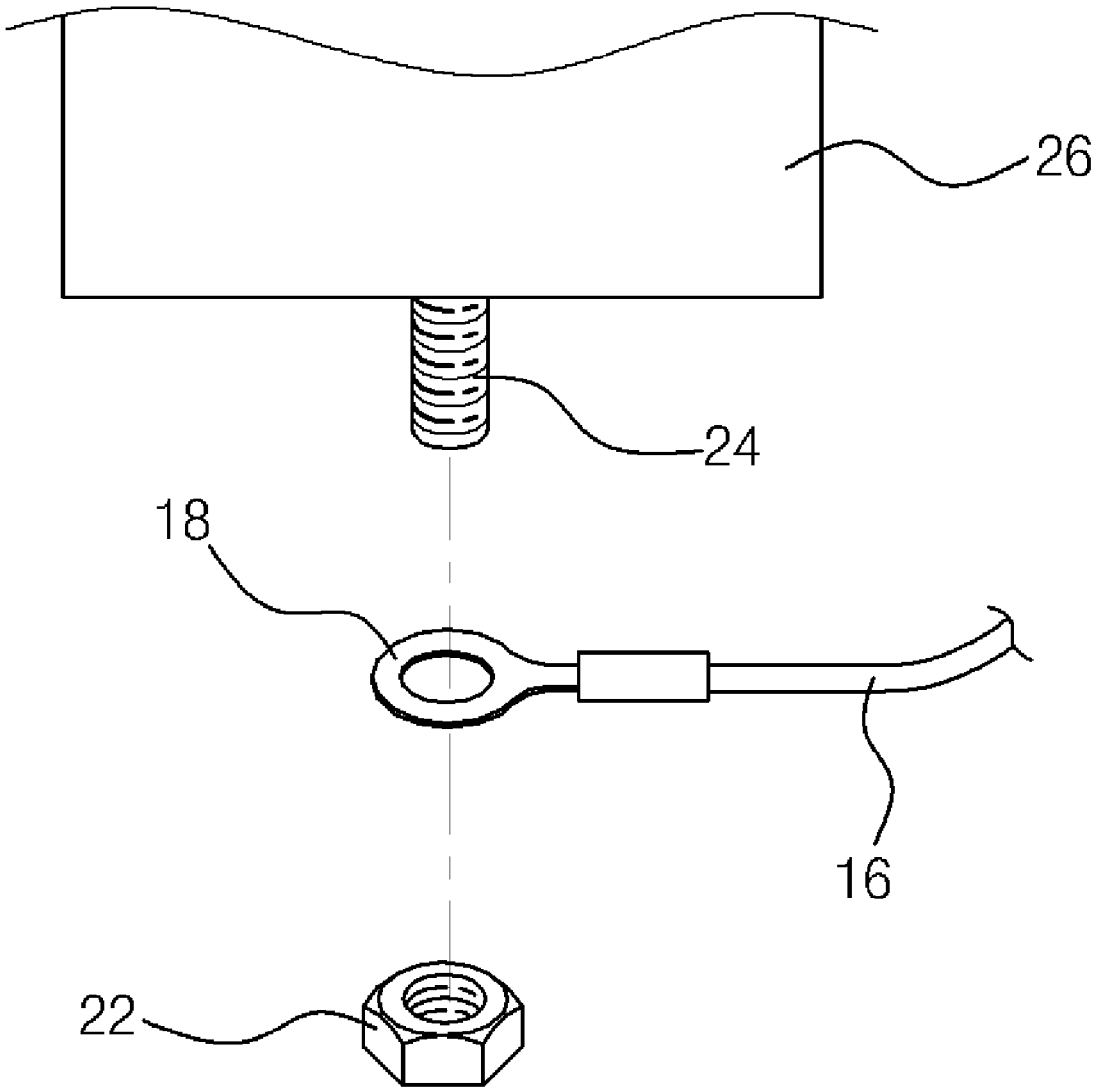
FIG. 13 (Prior Art)
FIG. 13 is a schematic diagram showing a connected state of the prior art engine condenser and an engine.

Reference numerals set forth in the Drawings includes reference to the following elements as further discussed below:

| | |
|---|---|
| 100: female connector | 100a; terminal receiving portion |
| 101: housing | 102: projection |
| 103: first guide groove | 104: second guide groove |
| 105: first locking projection | 106: second locking projection |
| 107: operating lever | 108: fulcrum |
| 108a: locking projection | 109: inner seal |
| 110: front holder | 111: connector cover |
| 112: body | 113: projection receiving portion |
| 114: first through hole | 115: second through hole |
| 116: receiving groove | 117: lever locking guide |
| 118: cut projection | 119: male connector |
| 120: housing | 121: locking projection |
| 122: guide rail | |

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

A connector according to an embodiment of the present invention includes a female connector 100, a male connector 119, and a connector cover 111 for protecting and maintaining the connected state of the female connector 100 and the male connector 119.

The female connector 100 includes a terminal receiving portion 100*a* into which a plurality of terminals for transmitting and receiving signals are inserted and a housing 101 which is formed in an oval shape and surrounds the circumference of the terminal receiving portion 100*a*.

The housing 101 includes a large diameter portion formed at the front thereof, in which the terminal receiving portion 100*a* is disposed in the inner portion thereof, and a small diameter portion formed at the rear portion thereof.

A rectangular projection 102 is formed on an upper end of the large diameter portion of the housing 101, a first guide groove 103 is formed on an upper wall of the projection 102 in the forward and backward direction, and a pair of second guide grooves 104 are formed on both side walls of the projection 102 in the forward and backward direction.

Here, the first guide groove 103 and the pair of second guide grooves 104 are arranged in parallel to each other. The first guide groove 103 guides the insertion of the connector cover 111 into the female connector 100 in the forward direction, and the second guide grooves 104 control the connector cover 111 to be pre-mounted on the female connector 100.

Moreover, a first locking projection 105 is formed at the rear of the first guide groove 103 on the upper surface of the projection 102, and a pair of second locking projections 106 are formed on both sides of the upper surface of the projection 102 in the width direction with the first guide groove 103 interposed therebetween.

Here, the first locking projection 105 and the pair of second locking projections 106 are arranged to form the apex of a triangle.

The housing 101 includes an operating lever 107 such that a user can push the operating lever 107 by hand to lock and unlock the female connector 100 and the male connector 119.

The operating lever 107 is horizontally disposed over the large and small diameter portions of the housing 101 in the forward and backward direction. The front portion of the operating lever 107, at which a locking projection 108*a* is provided, and the rear portion thereof, which is able to be pushed by hand, are configured to perform a seesaw motion with respect to a fulcrum 108 in the middle thereof.

The locking projection 108*a* at the front bottom of the operating lever 107 is used to maintain the connected state of the male connector 119 and the female connector 100.

An inner seal 109 of a flexible material (e.g., rubber) is inserted into the inside of the housing 101 to surround a portion of the terminal receiving portion 100*a* and maintain airtightness, and a front holder 110 is inserted between the bottom of the terminal receiving portion 100*a* and the bottom of the inner seal 109 to maintain the shape of the inner seal 109.

Here, the connector cover 111 is molded with ferrite powder, which is effective for removal of noise, and provided adjacent to the connector, a main source of noise. Therefore, the connector cover 111 can effectively remove/reduce the noise of the vehicle and further protect the connector from an external impact.

The connector cover 111 is mounted on the female connector 100 to surround the outer circumferential surface of the housing 101 of the female connector 100 and includes a body 112 for surrounding the circumferential surface of the large diameter portion of the housing 101 and a rectangular projection receiving portion 113 integrally formed on the top of the body 112 and surrounding the circumferential surface of the projection 102 of the housing 101.

A first through hole 114 is formed on the upper surface of the projection receiving portion 113 such that the first locking projection 105 of the female connector 100 is inserted and fixed thereto, and thereby it is possible to determine the mounting position of the connector cover 111.

A pair of second through holes 115 are formed in parallel to each other in the forward and backward direction with the first through hole 114 interposed therebetween to guide the movement of the connector cover 111 and prevent the connector cover 111 from being moved backward from the female connector 100.

Here, the first through hole 114 is formed to penetrate the upper surface of the projection receiving portion 113 with a size that can accommodate the first locking projection 105, and the second through holes 115 are formed to extend in the forward and backward direction such that the second locking projections 106 move within a predetermined distance in the forward and backward direction.

Moreover, a receiving groove 116 is formed in the inside of the upper end of the projection receiving portion 113 at the rear of the first through hole 114 and the second through holes 115 such that the first locking projection 105 and the second locking projections 106 can move therethrough.

A lever locking guide 117 is formed downward in the inside of the front end of the projection receiving portion 113 to be inserted into the first guide groove 103 when the connector cover 111 is pre-mounted on the housing 101 of the female connector 100. When the connector cover 111 is completely mounted on the female connector 100 as the lever locking guide 117 moves forward to the end of the first guide groove 103, the operating lever 107 of the female connector 100 cannot perform a seesaw motion and thereby the locked state of the female connector 100 and the male connector 119 is maintained.

A pair of cut projections 118 are formed on both side walls of the projection receiving portion 113 in the forward and backward direction, in which the front end of each cut projection 118 is integrally connected to the front end of the side wall of the projection receiving portion 113 and the remaining portion of the cut projection 118 is cut along the middle of the side wall of the projection receiving portion 113 in the forward and backward direction. Therefore, the cut projections 118 are elastically supported with respect to the front end thereof to be rotated or bent inward in the width direction of the projection receiving portion 113 such that the cut projections 118 are inserted into the second guide grooves 104 when the connector cover 111 is mounted on the housing 101 of the female connector 100.

The male connector 119 is inserted into the inside of the housing 101 of the female connector 100 and electrically connected to the female connector 100 such that the male and female connectors 119 and 100 can transmit and receive signals to and from each other.

A locking projection 121 is formed on an upper end of a housing 120 of the male connector 119. The locking projection 121 of the male connector 119 is connected to the locking projection 108*a* formed on the operating lever 107 of the female connector 100, and thereby the connected state of the male connector 119 and the female connector 100 can be maintained.

Moreover, a pair of guide rails 122 are formed in parallel to each other on an upper end of the housing 120 of the male connector 119. The guide rails 122 having a cross section of "¬" shape are inserted along the second guide grooves 104 formed on the projection 102 of the housing 101 of the female connector 100 such that the housing 120 of the male connector 119 is inserted into the inside of the housing 101 of the female connector 100 and connected thereto.

The use of the connector in accordance with an exemplary embodiment of the present invention having the above-described configuration will be described below.

First, the connector cover 111 is inserted into the outer circumferential surface of the female connector 100 to be pre-mounted thereto.

Here, a pre-mounting means for causing the connector cover 111 to be pre-mounted on the female connector 100 before the male connector 119 is inserted into the female connector 100 includes the second guide grooves 104 formed on both side walls of the projection 102 of the female connector 100, the second locking projections 106 formed to project from the upper end of the projection 102 of the female connector 100, the cut projections 118 formed on both side walls of the projection receiving portion 113 of the connector cover 111, and the second through holes 115 formed on the projection receiving portion 113 of the connector cover 111. Therefore, when the connector cover 111 is inserted into the outer circumferential surface of the female connector 100, the cut projections 118 are inserted into the second guide grooves 104 and stopped at the inner end of the second guide grooves 104 to prevent the connector cover 111 from further moving forward. Moreover, as the second locking projections 106 are inserted into the front ends of the second through holes 115, the connector cover 111 is prevented from moving backward.

Then, when the connector cover 111 is pre-mounted on the female connector 100, the male connector 119 is inserted and connected to the female connector 100.

A means for causing the male connector 119 to be inserted into the female connector 100 includes the guide rails 122 formed on the housing 120 of the male connector 119. When the guide rails 122 are inserted into the second guide grooves 104 of the female connector 100, the cut projections 118 of the connector cover 111 are pushed to the outside of the second guide grooves 104 such that the male connector 119 is inserted into the female connector 100.

A means for connecting and disconnecting the female connector 100 and the male connector 119 includes the operating lever 107 formed horizontally on the female connector 100, in which the front portion of the operating lever 107, at which the locking projection 108*a* is provided, and the rear portion thereof, which is able to be pushed by hand, perform a seesaw motion with respect to the fulcrum 108 in the middle thereof, and the locking projection 108*a* formed on the housing 120 of the male connector 119. When the male connector 119 is inserted into the inside of the female connector 100, the locking projection 121 of the male connector 119 raises the locking projection 108*a* of the operating lever 107 by the seesaw motion and then is connected to the locking projection 108*a* and, when the rear portion of the operating lever 107 is pushed, the front portion of the operating lever 107 is raised and then unlocked from the locking projection 121 of the male connector 119.

Then, the connector cover 111 is further moved forward to the female connector 100 to be double locked such that the connected state of the female connector 100 and the male connector 119 is maintained.

A means for maintaining the connected state of the locking projection 108*a* of the female connector 100 and the locking projection 121 of the male connector 119 and double locking the connected male and female connectors 119 and 100 includes the lever locking guide 117 formed on the upper end of the projection receiving portion 113 of the connector cover 111 and the first guide groove 103 formed on the upper end of the projection 102 of the female connector 100. When the connector cover 111 is moved forward as the cut projections 118 of the connector cover 111 are pushed to the outside of the second guide grooves 104 of the female connector 100 by the guide rails 122 of the male connector 119, the second locking projections 106 of the female connector 100 move along the second through holes 115 of the connector cover 111 to be positioned at the rear end of the second through holes 115. When the lever locking guide 117 moves forward along the first guide grove 103 to reach the inner end of first guide groove 103, the connector cover 111 does not move any further, and when the front portion of the operating lever 107 is positioned adjacent to the bottom of the lever locking guide 107, the operating lever 107 of the female connector 100 cannot perform a seesaw motion. As a result, the locking projection 121 of the male connector 119 cannot move backward by the locking projection 108*a* of the operating lever 107.

The position at which the connector cover 111 is mounted on the female connector 100 is determined by moving forward the connector cover 111 to the female connector 100.

When the connector cover 111 is moved forward, the first locking projection 105 formed on the projection 102 of the female connector 100 is inserted into the first through hole 114 formed on the projection receiving portion 113 of the connector cover 111, and thereby the user can determine the mounting position of the connector cover 111.

When the male connector 119 is connected to the female connector 100 in the above-described manner, the connector cover 111 can protect the connected state of the connector and further remove/reduce the electrical noise of the vehicle.

As described above, the connector in accordance with the present invention has the following advantages:

(1) Since the connector cover is molded with ferrite powder and installed adjacent to a noise source of the vehicle, it is possible to effectively remove/reduce the electrical noise;

(2) The female connector can be connected to and disconnected from the male connector using the operating lever; and (3) The connector cover is movably mounted on the circumferential surface of the female connector in the forward and backward direction such that when the connector cover moves backward, the operation of the operating lever is stopped by the lever locking guide to main the connected state of the female connector and the male connector and, when the connector cover moves forward, the female connector can be disconnected from the male connector by the operation of the operating lever.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. A connector for use in a vehicle, the connector comprising:

a female connector including a housing, a projection formed to project on top of the housing, an operating lever horizontally disposed over the housing in the forward and backward direction to perform a seesaw motion, and a locking projection formed at the front bottom of the operating lever;

a male connector configured to be inserted into the female connector and connected to the female connector by the locking projection; and a connector cover including a body configured to surround a circumferential surface of the housing of the female connector, a projection receiving portion projecting upward from an upper end of the body and surrounding the circumferential surface of the projection of the female connector, and a lever locking guide formed downward from an upper end of the projection receiving portion, wherein the lever locking guide prevents a front end of the operating lever from being raised such that the male connector and the female connector are double locked and the connector cover is molded with ferrite powder to remove or reduce noise of the vehicle.

2. The connector of claim 1, wherein the connector cover is pre-mounted on the circumferential surface of the female connector by a pre-mounting means including:

cut projections of the connector cover formed on both side walls of the projection receiving portion in the forward and backward direction, in which the front end of each cut projection is integrally connected to the front end of the side wall of the projection receiving portion and the remaining portion of the cut projection is cut from the projection receiving portion in the forward and backward direction therefore the cut projections are elastically supported with respect to the front end thereof to be rotated or bent inward in the width direction of the projection receiving portion, wherein the cut projections are inserted into a second guide groove formed on both side walls of the projection of the female connector in the forward and backward direction and stopped at the inner end of the second guide grooves to prevent the connector cover from further moving forward.

3. The connector of claim 2, wherein the male connector comprises a guide rail formed to project upward from a housing of the male connector in which the wide rail pushes the cut projection of the connector cover such that the connector cover moves forward in the female connector when the cut projection is inserted into the second guide groove formed on the female connector.

4. The connector of claim 2, wherein an upper end of the projection receiving portion of the connector cover comprises a first through hole through which a first locking projection formed on the upper surface of the projection of the female connector is inserted to allow a user to determine a position at which the connector cover is completely mounted on the female connector.

5. The connector of claim 4, wherein the connector cover is pre-mounted on the circumferential surface of the female connector by a pre-mounting means including: a second through hole of the connector cover formed on the upper end of the projection receiving portion in the forward and backward direction such that a second locking projection formed on the projection of the female connector is moved therethrough and the connector cover is prevented from moving backward by the second locking projection.

* * * * *